US006086348A

United States Patent [19]

Nothdurft et al.

[11] Patent Number: 6,086,348

[45] Date of Patent: Jul. 11, 2000

[54] FUEL INJECTION PUMP FOR INTERNAL COMBUSTION ENGINES

[75] Inventors: Heinz Nothdurft; Wolfgang Fehlmann, both of Stuttgart; Clemens Senghaas, Leingarten, all of Germany

[73] Assignee: Robert Bosch GmbH, Stuttgart, Germany

[21] Appl. No.: 09/043,795

[22] PCT Filed: Apr. 30, 1997

[86] PCT No.: PCT/DE97/00882

§ 371 Date: Oct. 13, 1998

§ 102(e) Date: Oct. 13, 1998

[87] PCT Pub. No.: WO98/04825

PCT Pub. Date: Feb. 5, 1998

[30] Foreign Application Priority Data

Jul. 29, 1996 [DE] Germany ..... 196 30 537

[51] Int. Cl.[7] ..... F01C 1/00

[52] U.S. Cl. ..... 418/260; 418/265; 418/266

[58] Field of Search ..... 418/259, 260, 418/265, 266

[56] References Cited

U.S. PATENT DOCUMENTS

| | | | |
|---|---|---|---|
| 2,832,199 | 4/1958 | Adams et al. . | |
| 2,910,976 | 11/1959 | Fancher . | |
| 3,113,527 | 12/1963 | Kramer . | |
| 3,138,112 | 6/1964 | Porta et al. . | |
| 3,785,758 | 1/1974 | Adams et al. | 418/260 |
| 4,041,921 | 8/1977 | Eckert et al. . | |
| 5,588,821 | 12/1996 | Kinoshita | 418/259 |
| 5,899,677 | 5/1999 | Ono et al. | 418/259 X |

*Primary Examiner*—Hoang Nguyen

*Attorney, Agent, or Firm*—Ronald E. Greigg; Edwin E. Greigg

[57] ABSTRACT

A fuel injection pump for internal combustion engines which has an integrated feed pump with an outer ring and an inner ring, the latter being coupled to a drive shaft of the fuel injection pump via a toothing. The individual teeth of this toothing extend with their respective end face and tooth bottom along a respective circular arc about a center point, which is located in the radial plane of the drive shaft extending through these teeth along the axis of the drive shaft. As a result, an increased angular offset between the drive shaft and the plane of the inner ring without the risk of wear is possible.

3 Claims, 1 Drawing Sheet

FUEL INJECTION PUMP FOR INTERNAL COMBUSTION ENGINES

PRIOR ART

The invention is based on a fuel injection pump as generically defined hereinafter. One such fuel injection pump is known from German Patent Application DE-A1 30 12 983. The toothing provided there on the circumference of the drive shaft has a substantially lesser height than the axial height of the inner ring. Feed pumps of this kind, also known from German Patent Application DE-A 28 49 012, having an inner ring and an outer ring, which are eccentric to one another with adjacent outer faces, so that there is an intermediate chamber between the wheels that comes continuously larger and then shrinks again. The intermediate chamber is subdivided by vanes, which are placed in radial slots of the inner ring and move radially outward under the influence of centrifugal forces or restoring forces and come to rest on the inner wall of the outer ring, thereby dividing the intermediate chamber into individual cell chambers. Via these cell chambers, the fuel is first aspirated and then delivered, compressed, to an outlet side as the shrinkage in the radial width between the outer and inner walls of the aforementioned wheels increases. The inner wheels of the pump are connected to the drive shaft either by toothing in accordance with DE-A 30 12 983 or by a spline and groove connection in accordance with DE-A 28 49 012. The spline and groove connection can also be understood as a set of teeth over a portion of the circumference. While in the latter of these embodiments the space required for the coupling between the inner ring and the drive shaft is very great, in the first of these embodiments, conversely, because of the toothing all the way around, the space required is substantially less for the same force transfer. Variable clearance tolerances, which because of the requisite tightness are especially low in the region of the feed pump but conversely can be greater in the region of the drive shaft and its coupling to the inner ring, mean that in the known embodiment high edge pressures can occur in the region of the toothing, because of angular deviations between the plane in which the inner ring of the feed pump is guided and the radial plane of the drive shaft through which the axis of the drive shaft passes at a right angle. This has the disadvantage of heavy wear and requires a high driving power.

ADVANTAGES OF THE INVENTION

By means of the fuel injection pump of the invention, it is attained that edge pressures are essentially avoided, and large load-bearing faces on the individual teeth of the sets of teeth are assured. The wear and the tendency to seizing between the inner ring and the toothing of the drive shaft and/or between the inner ring and the adjacent pump housing parts are reduced. Since the inner ring is now no longer exposed to tilting motions from, the drive side, the very close guidance of the inner ring that is essentially free of tilting forces, which can cause damage here, also follows. Because of the low friction, there is little wear, and it becomes possible to transmit higher torques for the same pumping capacity. The width of the toothing can be increased compared with the known embodiment, since because of the tooth design, even with wider teeth, tilting moments are no longer transmitted to the inner ring of the feed pump.

BRIEF DESCRIPTION OF THE DRAWING

An exemplary embodiment is shown in the drawing and will be described in further detail in the ensuing description.

DESCRIPTION OF THE EXEMPLARY EMBODIMENT

Figure 2:
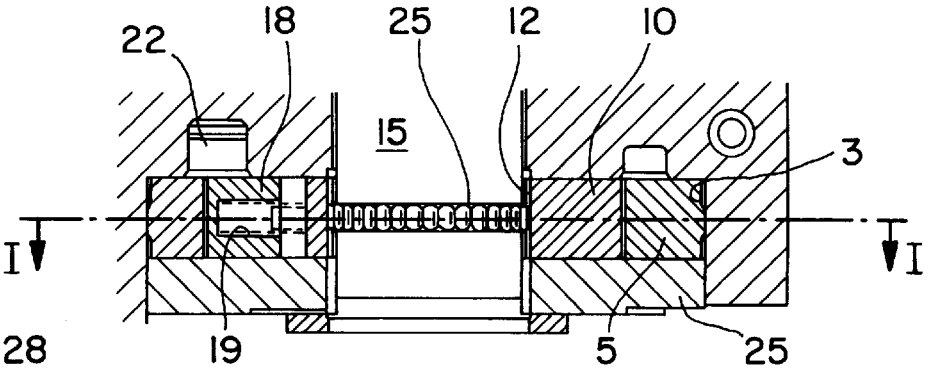
FIG. 2 is a section through the distributor pump of FIG. 2 taken along the line II—II.
Figure 1:
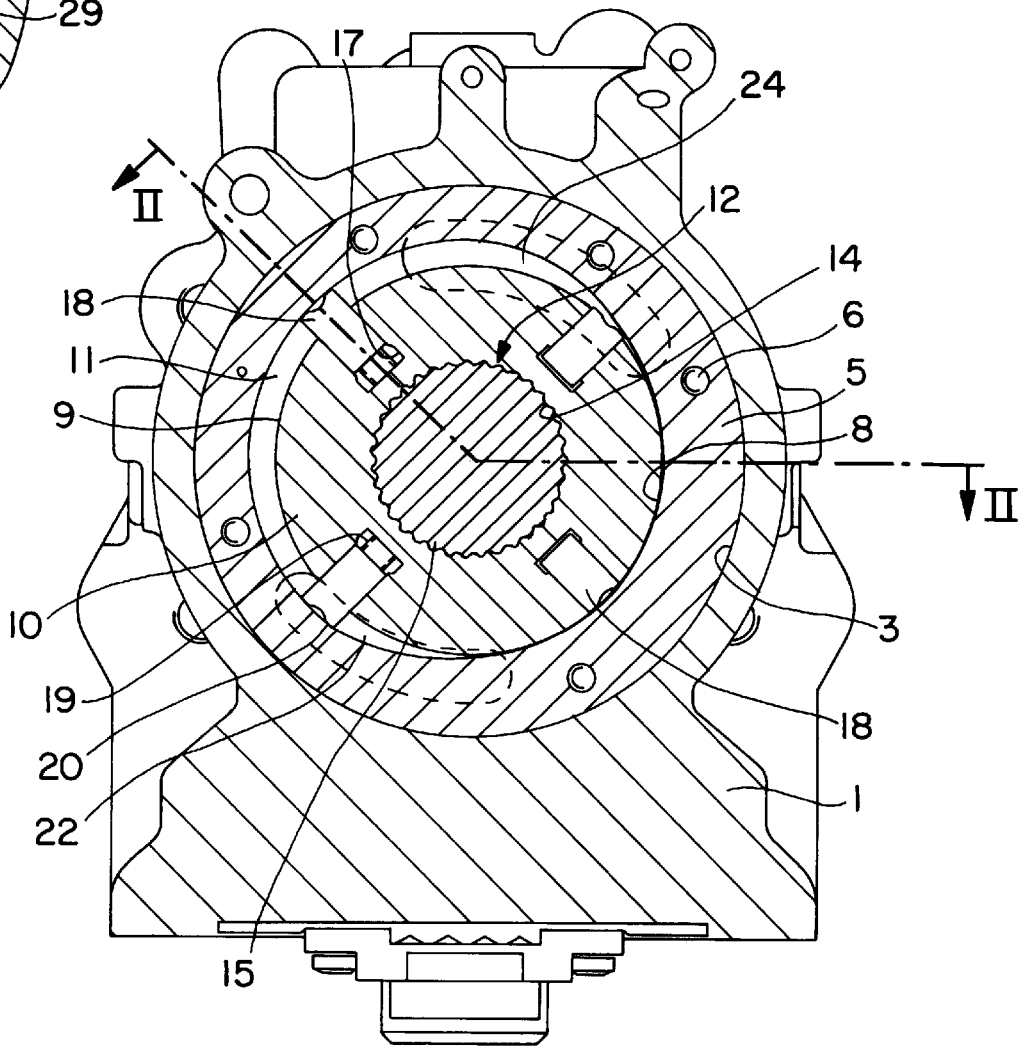
FIG. 1 is a section through a fuel injection pump of the distributor type in the region of the feed pump.

Fuel injection pumps of the distributor pump type typically have a feed pump integrated into the housing of the fuel injection pump. They may be embodied as a so-called reciprocating piston distributor pump, of the kind known from the prior art DE-A1 30 12 983 cited at the outset, having a pump piston which is driven to reciprocate and simultaneously rotate by a cam disk and acts as a distributor; the distributor injection pump may be embodied as a radial piston pump, with a cam ring on whose inward-pointing cam face radially located pump pistons are moved, which likewise supply a distributor which upon the rotation of the drive shaft triggers various fuel pump outlets, leading to injection valves, in succession. By means of the feed pump, fuel is aspirated and fed into a fuel injection pump interior, from which fuel is drawn by a high-powered pump in order to generate high injection pressures. The section in FIG. 1 shows a section through such a distributor injection pump in the region of the feed pump. In the housing 1 of the fuel injection pump, a circular-cylindrical chamber with a circular-cylindrical inner wall 3 is provided, into which chamber an outer ring 5 of the fuel feed pump is inserted, which ring with its outer wall comes into contact with the inner wall 3. The outer ring is secured in stationary fashion to the housing 1 by means of screws 6. Radially inward, the outer ring has an inner face 8, which in the embodiment described has a face whose shape is not circular-cylindrical and which together with a circular-cylindrical jacket face 9 of an inner ring 10 defines an intermediate chamber 11 of approximately crescent-shaped cross section. The inner ring has an inner jacket face 14 provided with a set of teeth 12, and it is coupled at this jacket face to a drive shaft 15 in form-locking fashion in the rotary direction, with corresponding teeth on the circumference of the drive shaft. From the jacket 9 of the inner ring, radial grooves 17 extend outward, being distributed at regular angular intervals, and into which disklike vanes 18 of rectangular cross section are guided as positive displacement elements. These elements are retained in contact with the inner face 8 of the outer ring with their end face 20 by means of a compression spring 19 supported inside the grooves 17; optionally, the vanes are also hydraulically reinforced by the outset pressure of the feed pump. The vanes subdivide the crescent-shaped chamber 11 into partial volumes, in such a way that upon a relative rotation of the inner ring with respect to the outer ring, the vanes 18 move these volumes, which because of the configuration of the crescent-shaped chamber decrease, thereby developing an increased feed pressure. An outlet conduit 22 leads away from one end of the crescent-shaped chamber, and the compressed fuel is fed in it. Opposite this conduit, on the other end of the crescent-shaped chamber 11, a kidney-shaped entrance 24 is provided, by way of which fuel is aspirated upon the rotation of the inner ring. FIG. 2 additionally shows the accommodation of the outer ring 5 and inner ring 10 in the cylindrical recess 3 as well as the cap which encloses these two rings in this recess and is secured together with the outer ring 5 to the housing. FIG. 2 also shows the coupling between the drive shaft 15 and the inner ring 10. It can be seen that the drive shaft, on its outer circumference, has a gear ring 25 with a straight spur gear; the axial height of the gear ring is substantially less than the axial height of the inner ring 10 and outer ring 5. This gear ring is the part of the toothing 12 toward the drive shaft in FIG. 1. It can be seen that by means of the cap, the inner ring 10 is guided very closely between the cap and the housing 1, which are the housing parts that enclose the feed pump. These parts also close off the crescent-shaped chamber 11 axially. The vanes 18 guided in the grooves are disposed in fitting fashion between these two housing parts, so that the partial chambers of the crescent-shaped chamber 11 are closed off as tightly as possible from one another, while observing the play required for motion.

Figure 3:
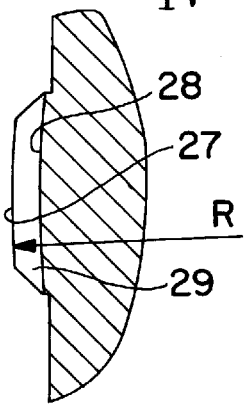
FIG. 3 shows a drive tooth as an enlarged detail, of the toothing on the drive shaft of the invention.

In FIG. 3, the embodiment according to the invention of the teeth in the set of teeth is now shown. In longitudinal section inside a radial plane through the axis of the drive shaft, the first face end 27 of the teeth (29) of the gear ring 25 extends along a circular arc having the radius R, whose center point is located in this radial plane. The tooth bottom 28 of the respective teeth 29 extends correspondingly.

Because of this embodiment, a deviation from what in principle is the precisely perpendicular location of the axis of the drive shaft 15 to the radial plane, defined by the axial boundary faces of the cap 5 and recess 3 and embodied in the sectional plane I—I, is possible. The contour of the teeth 29 extending in a circular arc longitudinally of the axis assures that if there is an angular offset, large-area contacts with the corresponding toothing 12 on the inner ring 10 will still occur, without generating to wear-promoting edge pressures. By avoiding these edge pressures, higher overall torques, which would otherwise cause rapid wear or destruction of the component, can be transmitted while the configuration remains the same. The gear ring 25, which is kept very narrow, can be widened in accordance with the above concepts, and because the tooth surface areas are larger a higher torque can again be transmitted to the feed pump, which in turn can thus output increased feeding capacity. In assembly and production, less stringent demands of accuracy in manufacture and assembly are made, which makes the fuel injection pump less expensive to produce.

The foregoing relates to preferred exemplary embodiments of the invention, it being understood that other variants and embodiments thereof are possible within the spirit and scope of the invention, the latter being defined by the appended claims.

What is claimed is:

1. A fuel injection pump for an internal combustion engine, comprising a drive shaft (15), with which at least one pump piston of the fuel injection pump is driven via actuating cams and with which a fuel feed pump disposed inside a housing of the fuel injection pump is driven, which comprises an inner ring (10), said inner ring (10) is guided by an inner jacket face (14) on the drive shaft (15), where said inner ring (10) is coupled thereto via a set of teeth (12), and an outer ring (5), between said outer ring (5) and the inner ring (10) positive displacement elements (18) coupled with these rings are disposed, by said displacement elements, fuel is fed from an inlet side (24) to an outlet side (22), and a fuel volume to be fed is enclosed between the inner ring (10), the positive displacement elements (18), the outer ring (5), and two housing parts (5, 25) that tightly guide these parts, the set of teeth form a spur gear, said teeth on a circumference of the drive shaft (15) and tooth (29) on the inner jacket face (14) of the inner ring (10), of said teeth on at least one of the parts, that is, the drive shaft (15) or inner ring (10), the teeth (29) on the jacket face (14) of the inner ring (10), form a spur toothing (12), and the teeth (29), located in the radial planes of the axis of the drive shaft (15) that extend longitudinally of this axis extend in an arc on this respective plane, with an envelope circle which defines the end face (27) of the teeth (29) and whose center point is located in this respective radial plane.

2. The fuel injection pump in accordance with claim 1, in which both the face end (27) and the tooth bottom (28) of the teeth (29) extend in an arc.

3. The fuel injection pump in accordance with claim 1, in which the positive displacement elements are vanes (18) guided in radial grooves (17) of the inner ring (10), said vanes come to rest on the inner face (8) of the outer ring (5) and on the adjoining ones of the housing parts (3, 25), and the outer jacket face (9) of the inner ring (10) together with the inner face (8) of the outer ring (5) define an approximately crescent-shaped chamber (11).

* * * * *